US010946296B1

(12) United States Patent
Girlya et al.

(10) Patent No.: US 10,946,296 B1
(45) Date of Patent: Mar. 16, 2021

(54) SCISSOR LIFT CONSTRUCTION EQUIPMENT AMUSEMENT RIDE

(71) Applicant: Diggerland USA, LLC, West Berlin, NJ (US)

(72) Inventors: Ilya Girlya, West Berlin, NJ (US); Yan Girlya, West Berlin, NJ (US)

(73) Assignee: Diggerland USA, LLC, West Berlin, NJ (US)

( * ) Notice: Subject to any disclaimer, the term of this patent is extended or adjusted under 35 U.S.C. 154(b) by 0 days.

(21) Appl. No.: 16/812,694

(22) Filed: Mar. 9, 2020

Related U.S. Application Data

(63) Continuation of application No. 29/662,954, filed on Sep. 11, 2018, now Pat. No. Des. 881,789.

(51) Int. Cl.
*A63G 31/14* (2006.01)
*B66F 11/04* (2006.01)

(52) U.S. Cl.
CPC ..... *A63G 31/14* (2013.01)

(58) Field of Classification Search
CPC ..... A63G 1/44; A63G 31/00; A63G 31/02; A63G 31/10; A63G 31/16; A63G 31/14; B66F 11/042; B66F 7/065; B66F 11/04; B66F 7/08
USPC ..... 472/2, 42, 131, 136
See application file for complete search history.

(56) References Cited

U.S. PATENT DOCUMENTS

| | | | | |
|---|---|---|---|---|
| 3,081,083 | A * | 3/1963 | Gregory | A63G 1/46 472/2 |
| 4,375,248 | A * | 3/1983 | Kishi | E04G 1/22 182/141 |
| 4,930,598 | A * | 6/1990 | Murrill | B66F 11/042 182/141 |
| D316,688 | S | 5/1991 | Barginear | |
| D467,526 | S | 12/2002 | Binette | |
| 8,505,684 | B1 * | 8/2013 | Bogue | B66F 11/042 182/19 |
| 8,678,940 | B2 | 3/2014 | Willcox | |
| 8,690,694 | B2 * | 4/2014 | Barber | A63G 31/00 472/50 |
| D733,005 | S | 6/2015 | Erwin | |
| D738,806 | S | 9/2015 | Williamson et al. | |
| D761,160 | S | 7/2016 | Gilles Duros et al. | |
| D779,380 | S | 2/2017 | van den Berg | |
| D803,102 | S | 11/2017 | Pletcher | |
| D845,176 | S | 4/2019 | McElwain | |

(Continued)

*Primary Examiner* — Kien T Nguyen
(74) *Attorney, Agent, or Firm* — Christopher J. Scott

(57) ABSTRACT

An amusement ride providing the sensation of riding scissor lift construction equipment to ride passengers is disclosed. The amusement ride has a scissor lift mechanism supported by a construction equipment frame with wheels thereon. A stationary support structure supports the equipment frame and suspends the wheels in midair to hold the equipment stationary. A cargo lift platform connected on top of the scissor lift mechanism has amusement ride seats mounted thereon. The ride seats have passenger restraints which provides amusement-ride-level safety. An electric motor drivingly connected to the scissor lift mechanism is operated by a ride operator to raise and lower the cargo lift platform. A passenger access platform situated adjacent the cargo lift platform allows ride passengers to easily and safely enter and exit the scissor lift.

12 Claims, 7 Drawing Sheets

(56) References Cited

U.S. PATENT DOCUMENTS

| | | | |
|---|---|---|---|
| D864,032 | S | 10/2019 | Bernard |
| D865,570 | S | 11/2019 | Sablatura |
| D872,655 | S | 1/2020 | Green |

* cited by examiner

SCISSOR LIFT CONSTRUCTION EQUIPMENT AMUSEMENT RIDE

CROSS-REFERENCE TO RELATED APPLICATION

This application is a continuation-in-part of earlier filed U.S. application Ser. No. 29/662,954, filed Sep. 11, 2018 which application is expressly incorporated by reference herein.

BACKGROUND OF THE INVENTION

This invention generally relates to amusement rides, and more particularly to amusement rides providing realistic construction equipment operation experiences with amusement-ride-level safety.

Children and those still a child at heart enjoy amusement ride experiences which incorporate sensations such as rapid acceleration, swift change in direction/orientation, or extreme change in elevation through the use of various types of amusement ride structures and their mechanical devices which move them. In a related way, children (more often boys) also have a particular interest in construction equipment and how construction equipment uses mechanical devices to move people and materials during construction activities. However, construction equipment, such as bulldozers and dump trucks for example, are not intended to be used as amusement rides and are thus generally not safe for children and those unskilled with their use to experience their use. Therefore, people interested in the operation and movement of construction equipment from a recreational point of view have been restricted to being merely spectators.

The inventors have invented ways to give amusement ride riders the experience of using construction equipment while providing them with amusement-ride-level safety by modifying standard construction equipment with amusement-ride-standard safety features. One example of the inventors' invention in this area is disclosed in U.S. Pat. No. 10,166,485 issued Jan. 1, 2019, entitled Dump Trailer Amusement Ride, which reference is expressly incorporated by reference in its entirety.

The present invention provides another construction equipment type amusement ride in the form of a scissor lift which is often used in construction areas to lift people and/or materials high into the air to reach high building structures, such as second or higher-level floors, vaulted or domed ceilings, or roofs of buildings for example.

SUMMARY OF THE INVENTION

An amusement ride providing the sensation of riding scissor lift construction equipment to ride passengers. The ride has a scissor lift mechanism supported by a construction equipment frame with wheels thereon. A stationary support structure supports the frame and suspends the wheels in midair to hold the frame stationary. A cargo lift platform connected on top of the scissor lift mechanism has amusement ride seats mounted thereon. The ride seats have passenger restraints which provides amusement-ride-level safety. An electric motor drivingly connected to the scissor lift mechanism is operated to raise and lower the cargo lift platform. A passenger access platform situated adjacent the cargo lift platform allows ride passengers to safely enter and exit the scissor lift amusement ride.

BRIEF DESCRIPTION OF THE DRAWINGS

The drawings constitute a part of this specification and include a preferred embodiment to the invention, which may be embodied in various forms. It is to be understood that in some instances various aspects of the invention may be shown exaggerated or enlarged to facilitate an understanding of the invention.

DETAILED DESCRIPTION OF A PREFERRED EMBODIMENT

Detailed descriptions of a preferred embodiment is provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
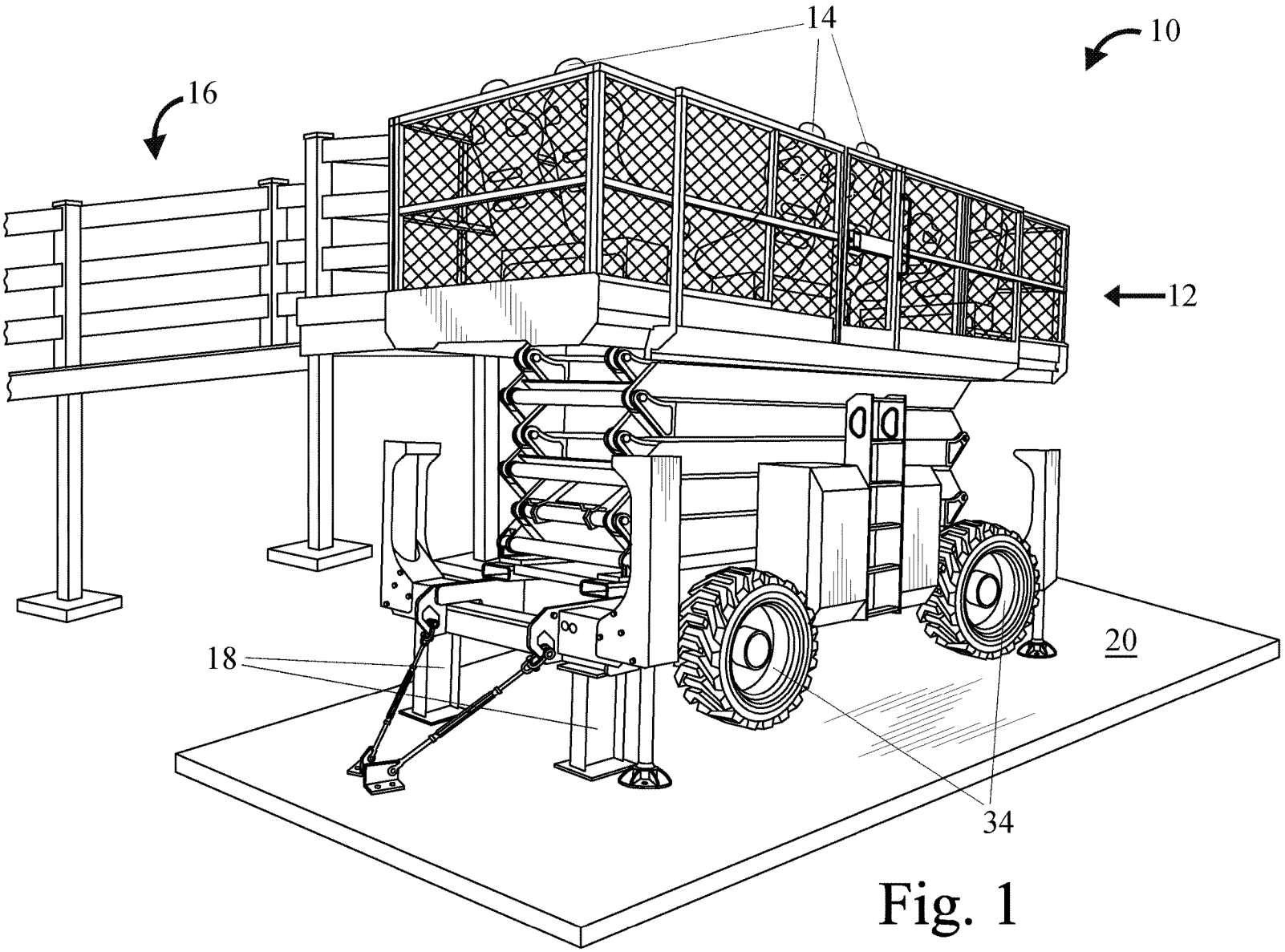
FIG. 1 shows a perspective view of a preferred embodiment of a scissor lift construction equipment amusement ride according to the invention while in a lowered position.
Figure 2:
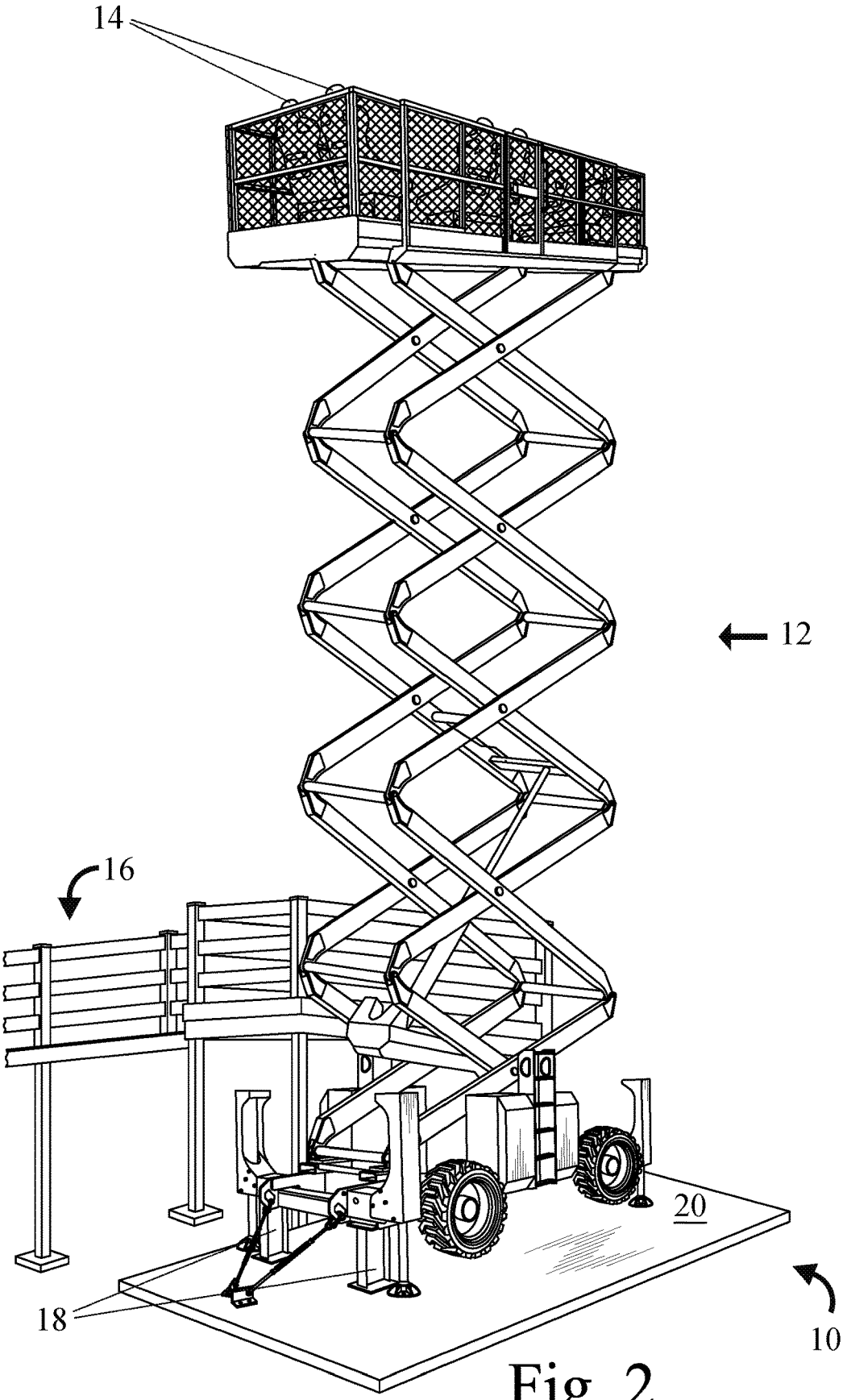
FIG. 2 shows the amusement ride of FIG. 1 while in a raised position.

FIGS. 1 and 2 show a perspective view of a preferred embodiment of a scissor lift construction equipment amusement ride 10. Amusement ride 10 generally comprises a piece of construction equipment 12 in the form of a scissor lift which has been modified and fitted with amusement-ride-level safety accommodations: amusement ride seats 14, ride access ramp 16 and fixed support stands 18 bolted to concrete support pad 20.

The scissor lift construction equipment 12 shown throughout the figures is a Genie® GS 5390 Scissor Lift. Information regarding this particular scissor lift is available at genielift.com/en/aerial-lift/rough-terrain-scissor-lifts. It should be appreciated however, that different brands, models and types of scissor lift construction equipment may be used in place of the one shown. For example, a JLG®530LRT scissor lift may be used. Information regarding this particular scissor lift is available at jlg.com/en/equipment/scissor-lifts. Other smaller scissor lifts accommodating fewer passengers may be used in situations where smaller equipment is desirable given the circumstances.

Amusement ride seats 14 shown throughout the figures are illustrated as JAZ Products Turbo Pro Model 101-150-01 polyethylene seats. Information regarding this particular seat is available at jazproducts.com/store/turbo-pro. JAZ Products Inc. 1212 E. Santa Paula St., Santa Paula, Calif. 93060. It should be appreciated however, that different brands and models of seats may be used in place of the type shown. For example, Hunsaker USA manufactures multiple types of polyethylene bucket seats which may be used in place of the ones shown. Information regarding Hunsaker seats is available at hunsakerusa.com/collections/bucket-seats.

Figure 3:
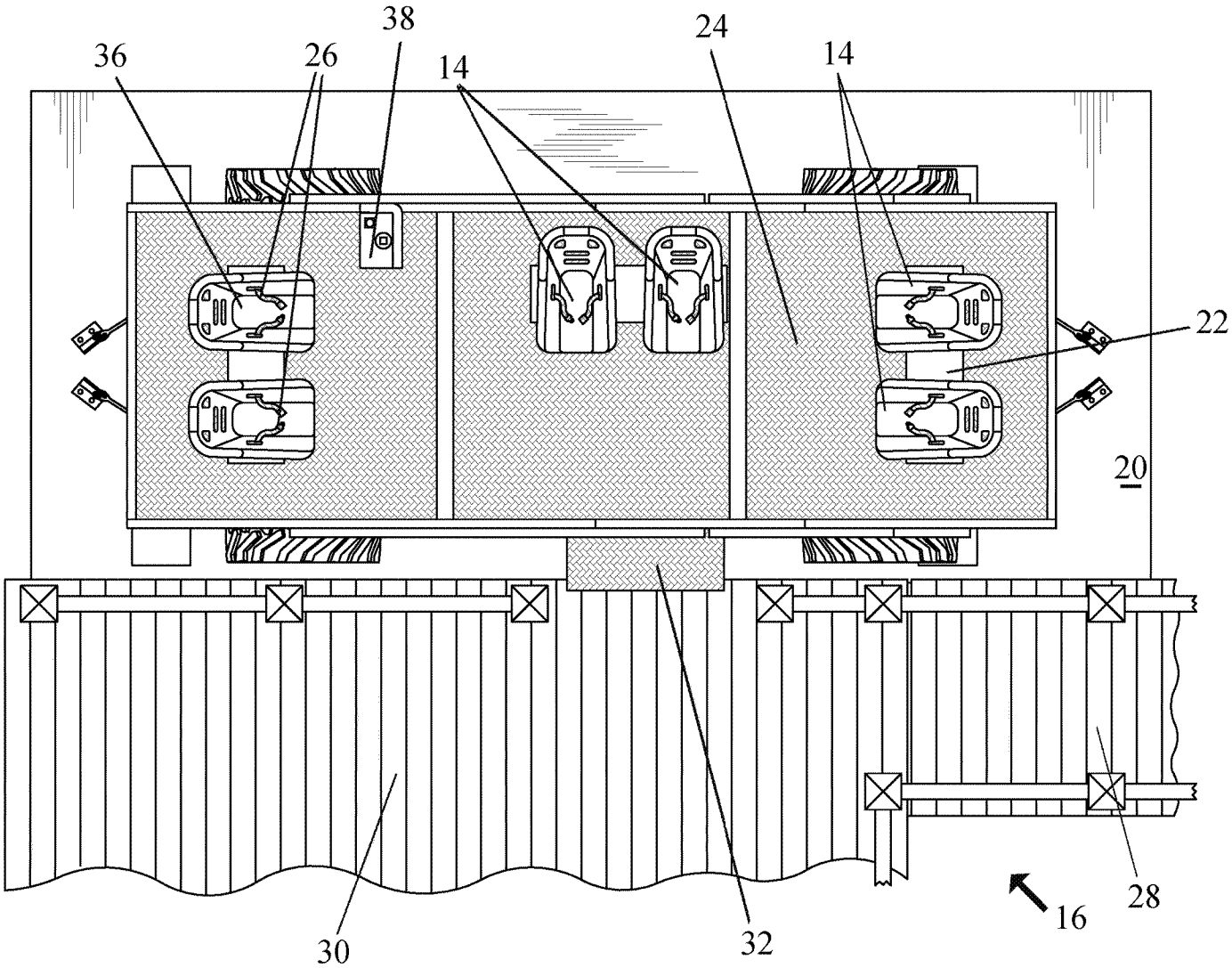
FIG. 3 shows an overhead plan view of the amusement ride of FIG. 1.

FIG. 3 shows three sets of two amusement ride seats (14) with each set of seats (14) bolted to a seat pedestal (22). Each seat pedestal 22 is bolted to scissor lift cargo platform 24. The three sets of seats are positioned on cargo platform 24 to evenly distribute weight load created by ride passengers. Each seat is shown as having a lap belt safety restraint (26). Other types and/or styles of safety restraints may also be used and/or incorporated.

Figure 4:
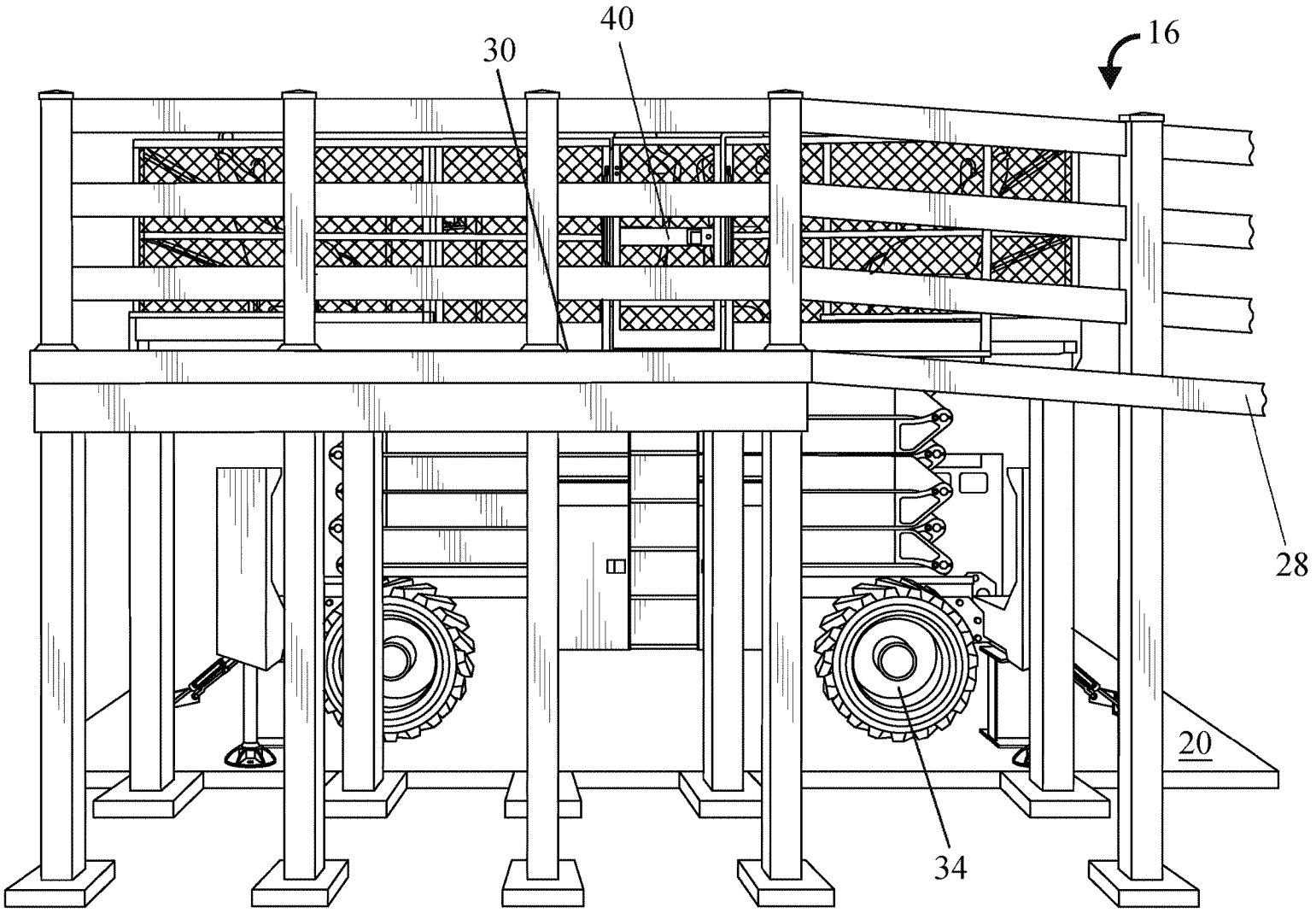
FIG. 4 shows a platform-side, side elevational view of the amusement ride of FIG. 1 while in a lowered position.
Figure 7:
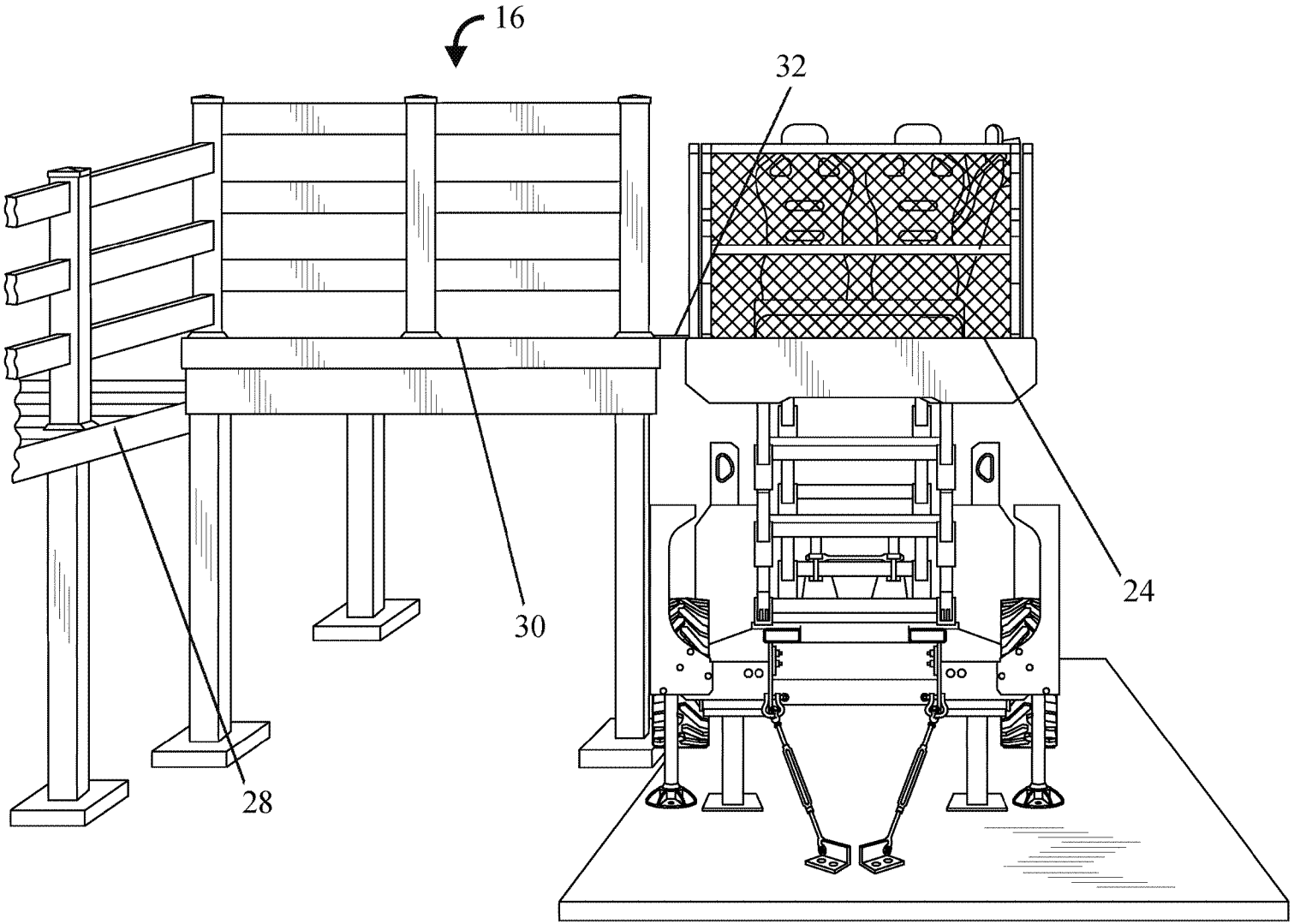
FIG. 7 shows an elevational end view of the amusement ride of FIG. 1.

FIGS. 4 and 7 show ride access ramp 16 has an inclined ramp section (28) which leads to level ramp platform section 30 that is elevated at a height generally the same level as scissor lift platform 24 (FIG. 7). Gap plate 32 spans the gap between level ramp platform section 30 and scissor lift platform 24 to prevent riders from injury by getting a foot caught between the two when entering and exiting lift 12.

Figure 6:
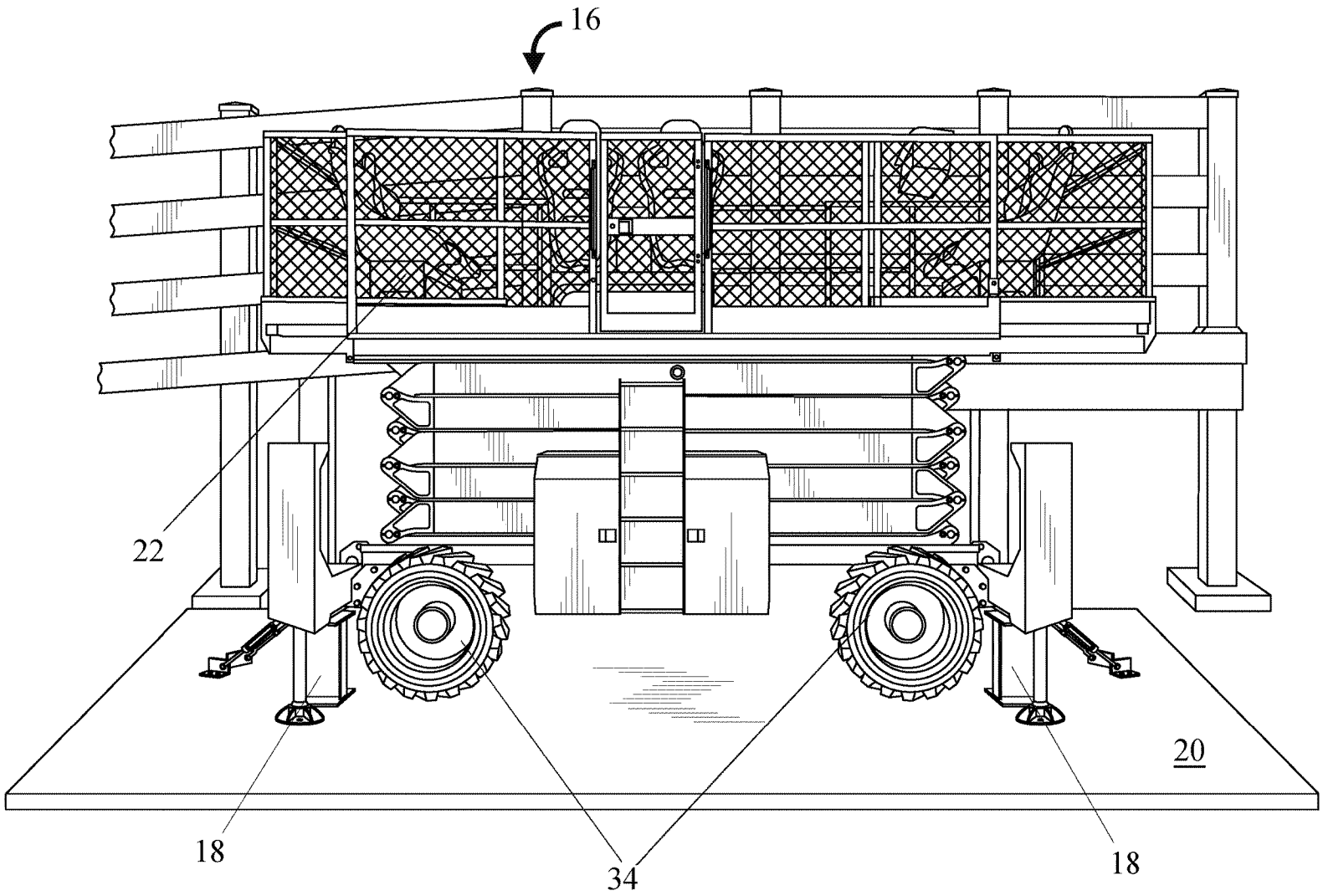
FIG. 6 shows a ride-side, side elevational view of the amusement ride of FIG. 1 while in a lowered position.

Lift 12 is incorporated into amusement ride 10 by being held stationary to provide an enhanced level of safety to ride passengers. Wheels 34 (FIG. 1) are attached to the frame upon which a motor-driven scissor of lift mechanism 12 is supported. The wheels 34 are preferably suspended above or over concrete support pad or support surface 20 by fixed support stands 18 which prevents the amusement ride 10 from moving relative to the support surface 20. Comparatively referencing FIGS. 1, 6, and 7, the reader will note the series of wheels 34 are preferably connected to the frame inwardly of the series of fixed support stands 18 when viewed laterally as generally depicted in FIG. 6. Further, the series of wheels 34 are preferably connected to the frame outwardly of the series of fixed support stands 18 when viewed on end as generally depicted in FIG. 7. The series of wheels thereby partially obscure the fixed support stands 18 depending on a viewpoint of the at least one ride passenger as generally depicted in FIG. 1.

Operation and control of amusement ride 10 is carried out by an operator (not shown) sitting in seat 36 (FIG. 3) who uses the factory installed control panel 38 to raise and lower scissor lift platform 24.

Figure 5:
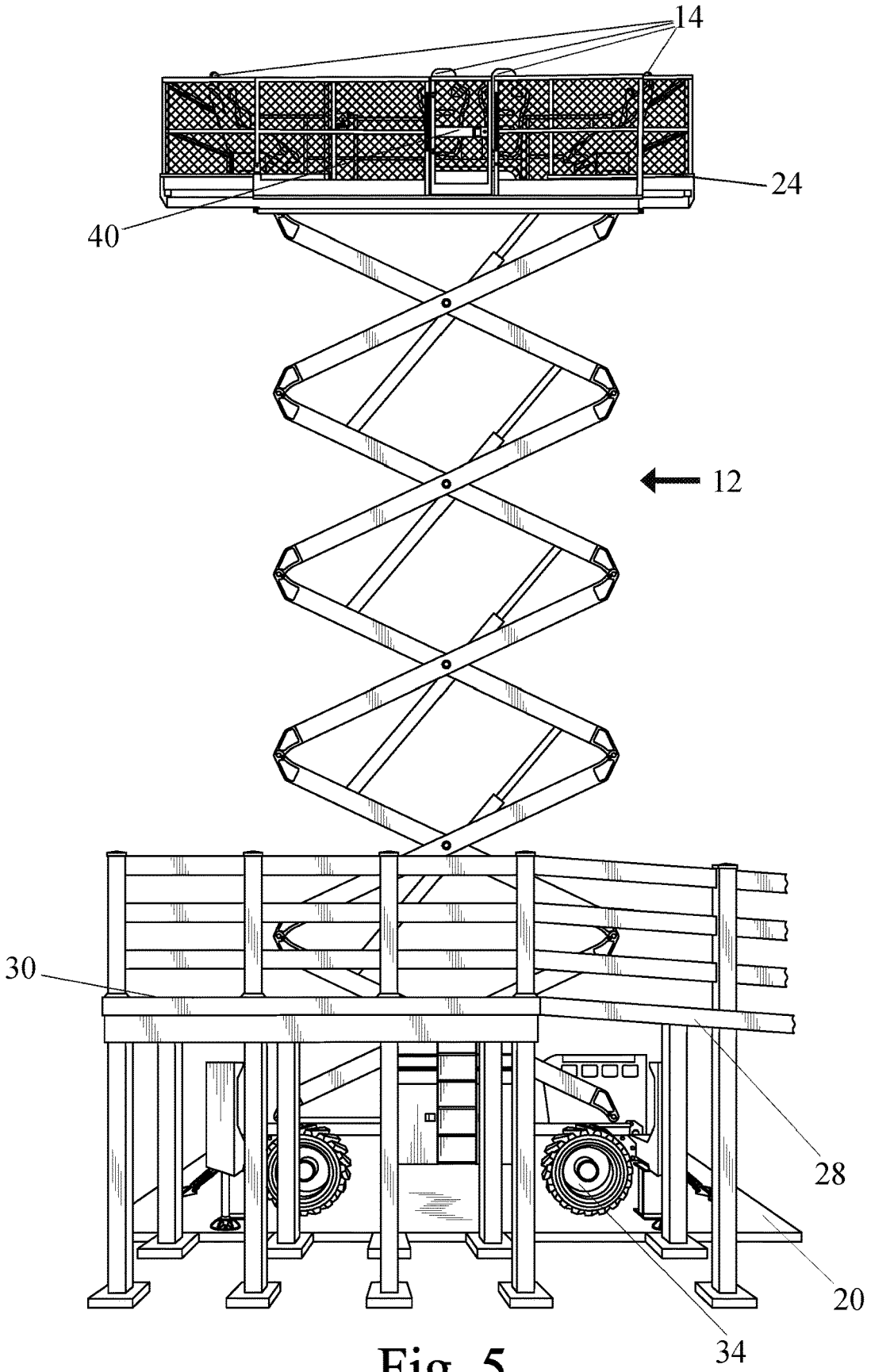
FIG. 5 shows the view of FIG. 4 while the ride is in a raised position.

Amusement ride 10 is generally operated by ride passengers using ride access ramp 16 (FIG. 4) to enter lift 12 through lift gate 40 while lift 12 is in its lowered position as shown in FIGS. 1, 4, 6 and 7. The passengers sit in seats 14 and secure lap belt safety restraints 26 across their body. The ride operator then checks the ride passengers to ensure proper securement of safety restraints and is then seated to operate ride 10. The operator uses control panel 38 to actuate the scissor lift arms which lift scissor lift platform 24 into the air as shown in FIGS. 2 and 5. Once at a desired height, typically at or near the highest height lift 12 is capable of achieving at current conditions, the ride operator pauses for a period of time. Ride passengers are allowed to appreciate the sensation of being lifted to such a height by a piece of mechanical construction equipment and then can appreciate the view around the ride from such a height. The operator then lowers the lift and allows ride passengers to exit via ride access ramp 16.

While the invention has been illustrated and described in detail in the drawings and foregoing description, the same is to be considered as illustrative and not restrictive in character, it being understood that only one preferred embodiment has been shown and/or described and that all changes and modifications that come within the spirit of the invention are desired to be protected.

What is claimed is:

1. An amusement ride providing the sensation of riding scissor lift construction equipment to ride passengers, comprising:

a scissor lift mechanism supported by a frame with a series of wheels connected to said frame;

a stationary support structure attached to and supporting said frame and suspending said series of wheels above a support surface, the stationary support structure comprising a series of fixed support stands, the series of fixed support stands being respectively positioned adjacent corners of the frame extending downwardly therefrom and being partially obscured by the series of wheels, the fixed support stands being attached to the support surface for preventing movement of the frame relative thereto;

a scissor-lift platform connected on top of said scissor lift mechanism;

an amusement ride seat mounted on said scissor-lift platform;

a passenger restraint on said seat;

an electric motor drivingly connected to said scissor lift mechanism; and a ride access ramp, the ride access ramp comprising a passenger access platform, the passenger access platform being situated adjacent to said scissor-lift platform when said scissor lift mechanism and said scissor-lift platform are in a lowered position.

2. The amusement ride of claim 1, wherein said electric motor is held by said frame.

3. An amusement ride, comprising:

a scissor lift mechanism supported by a frame with wheels connected to said frame;

a series of fixed support stands, the series of fixed support stands being attached to the frame extending downwardly therefrom and being partially obscured by the wheels, the fixed support stands being attached to a support surface thereunder for preventing movement of the frame relative to the support surface;

a scissor-lift platform connected on top of said scissor lift mechanism;

an amusement ride seat mounted on said scissor-lift platform;

an electric motor drivingly connected to said scissor lift mechanism; and a passenger access platform situated adjacent to said scissor-lift platform when said scissor lift mechanism and said scissor-lift platform are in a lowered position.

4. The amusement ride of claim 3, wherein said electric motor is held by said frame.

5. The amusement ride of claim 3, further comprising a passenger restraint on said seat.

6. The amusement ride of claim 5, wherein said electric motor is held by said frame.

7. An amusement ride, the amusement ride for providing the sensation of riding scissor lift construction equipment to ride passengers, the amusement ride comprising:

a motor-driven scissor lift mechanism, the motor-driven scissor lift mechanism being attached to and supported by a frame;

a series of fixed support stands, the series of fixed support stands being attached to the frame extending downwardly therefrom, the fixed support stands being further attached to an underlying support surface for preventing movement of the frame relative to the underlying support surface;

a passenger platform being attached to and supported by the motor-driven scissor lift mechanism;

an amusement ride seat being attached to and supported by the passenger platform; and a passenger access platform situated adjacent to the passenger platform when the motor-driven scissor lift mechanism is in a lowered position, the passenger access platform for supporting ride passengers and enabling ride passengers to access the amusement ride seat supported by the passenger platform when the motor-driven scissor lift mechanism is in the lowered position, the motor-driven scissor lift mechanism being operable to linearly raise the passenger platform upwardly away from the passenger access platform and linearly lower the passenger platform downwardly toward the passenger access platform for providing the sensation of riding scissor lift construction equipment to ride passengers.

8. The amusement ride of claim 7 wherein the series of fixed support stands are attached to the frame adjacent corners thereof.

9. The amusement ride of claim 7 wherein a series of wheels are connected to the frame.

10. The amusement ride of claim 9 wherein the series of wheels are suspended above the underlying support surface by way of the series of fixed support stands.

11. The amusement ride of claim 10 wherein a series of wheels are connected to the frame inwardly of the series of fixed support stands when viewed laterally and outwardly of the series of fixed support stands when viewed on end, the series of wheels thereby partially obscuring the fixed support stands depending on a viewpoint of the ride passengers.

12. The amusement ride of claim 7 wherein a ride access ramp extends from the passenger access platform, the ride access ramp comprising an inclined ramp section for enabling ride passengers to access the passenger access platform.

* * * * *